US005217051A

United States Patent [19]

Simpson et al.

[11] Patent Number: 5,217,051

[45] Date of Patent: Jun. 8, 1993

[54] FUEL VAPOR RECOVERY SYSTEM

[75] Inventors: W. Dwain Simpson, Wilton; James H. Pyle, Weston, both of Conn.

[73] Assignee: Saber Equipment Corporation, Stratford, Conn.

[21] Appl. No.: 791,048

[22] Filed: Nov. 12, 1991

[51] Int. Cl.[5] ..... B67D 5/40

[52] U.S. Cl. ..... 141/59; 141/46; 141/45; 141/DIG. 1; 417/420; 417/405

[58] Field of Search ..... 141/44-46, 141/59, 192, 290, DIG. 1; 417/352, 405, 406, 408, 420

[56] References Cited

U.S. PATENT DOCUMENTS

| | | | |
|---|---|---|---|
| 1,610,454 | 12/1926 | Lawaczeck | 417/406 |
| 3,016,928 | 1/1962 | Brandt | 141/45 |
| 3,826,291 | 7/1974 | Steffens | 141/59 |
| 3,860,064 | 1/1975 | Murphy . | |
| 3,910,050 | 10/1975 | Matthews et al. | 417/405 X |
| 4,009,739 | 3/1977 | Weatherford | 141/59 |
| 4,068,687 | 1/1978 | Long | 141/59 |
| 4,082,122 | 4/1978 | McGahey | 141/5 |
| 4,115,040 | 9/1978 | Knorr | 417/420 |
| 4,167,958 | 9/1979 | Voelz | 141/290 X |
| 4,187,958 | 2/1980 | King | 222/57 |
| 4,202,385 | 5/1980 | Voelz | 141/59 |
| 4,722,661 | 2/1988 | Mizuno | 417/420 X |
| 5,038,838 | 8/1991 | Bergamini et al. | 141/59 |
| 5,040,577 | 8/1991 | Pope | 141/59 |
| 5,123,817 | 6/1992 | Willemsen | 141/59 X |
| 5,150,742 | 9/1992 | Motohashi et al. | 141/59 |

FOREIGN PATENT DOCUMENTS

| | | | |
|---|---|---|---|
| 0372721 | 3/1923 | Fed. Rep. of Germany | 417/408 |
| 1018206 | 10/1957 | Fed. Rep. of Germany | 417/408 |
| 0244176 | 12/1925 | United Kingdom | 417/406 |

*Primary Examiner*—Henry J. Recla
*Assistant Examiner*—Casey Jacyna
*Attorney, Agent, or Firm*—Gottlieb, Rackman & Reisman

[57] ABSTRACT

An improved vapor recovery system for use in a fuel dispensing arrangement is disclosed employing two concentrically arranged hoses. The inner hose includes a turbine disposed therein which rotates in response to fuel flowing therethrough. The outer hose includes a turbine which is preferably magnetically coupled to the turbine included within the inner hose. Rotation of the turbine in the inner hose causes rotation of the turbine in the outer hose and rotation of the turbine in the outer hose creates a vacuum which recovers vapors from the fuel being dispensed.

12 Claims, 3 Drawing Sheets

FUEL VAPOR RECOVERY SYSTEM

TECHNICAL FIELD OF INVENTION

The invention relates to fuel-dispensing systems, and more particularly, to an improved vapor recovery system for use in a fuel-dispensing system.

DESCRIPTION OF THE PRIOR ART

Vapor recovery systems are utilized primarily in fuel dispensing systems, and particularly in consumer gasoline dispensing stations. Vapor recovery systems are intended to reduce harmful vapors which emanate from the fuel as it is dispensed into an automobile.

FIG. 1 shows a fuel hose inserted into the gasoline tank of a typical automobile. As the fuel exits nozzle 102 and empties into automobile 103, vapors from the fuel tank and the fuel being dispensed emanate from around the nozzle and specifically from the area labelled 101 in FIG. 1. Typically, prior art vapor recovery systems include a gasket 104 which tends to seal off the vapor from the open atmosphere. The vapors are collected underneath gasket 104 and are pumped through additional channel 105 back to the fuel storage tank.

In order to force the vapors back along additional channel 105, several techniques have been used in the prior art. The most straightforward technique is to simply rely upon the pressure created by the fuel filling the automobile's gas tank. Specifically, as the volume of fuel in the automobile's gas tank increases, less space is available for air therein. Accordingly, the air in the gas tank is forced out underneath gasket 104. This in turn forces any vapors up additional channel 105 toward the fuel storage tank (not shown).

Other techniques of the prior art have utilized electromechanical pumps back at the fuel storage tank or elsewhere in the fuel dispensing plumbing to create a powered vacuum within additional channel 105, thereby sucking the vapors back into the fuel storage tank. Such pumps are usually bulky and expensive.

Ideally, the power forcing the vapors back along additional channel 105 to the fuel storage tank should be proportional to the rate at which fuel is being dispensed so that as the need for vapor recovery increases, the vacuum will get stronger. U.S. Pat. No. 4,082,122 issued to McGahey on Apr. 4, 1978, describes a system which creates a vapor recovery vacuum that is proportional to the rate at which fuel is being dispensed. Disadvantageously, however, the equipment required is bulky and a transmission is required to operate the arrangement of the '122 patent.

Another prior art attempt at overcoming the above problem is described in U.S. Pat. No. 4,202,385 issued to Voelz, et al., on May 15, 1982. The Voelz arrangement describes a system which includes two parallel hoses, one for dispensing fuel and one for recovering vapors. As shown in FIG. 2 of the Voelz patent, as the gasoline flows it rotates a turbine 56 which is magnetically coupled to a blower 60 in the other hose. The magnetic coupling is arranged so that as the turbine turns, the blower turns in the opposite direction and creates a vacuum in the opposite hose. Thus, as the rate of fuel being dispensed increases, the rotation speed of blower 60 increases, and the vacuum created thereby strengthens.

The arrangement of Voelz overcomes many of the problems of the prior art systems previously described herein. However, a new set of problems arise. First, it can be seen from FIG. 2 of the Voelz patent that two parallel hoses are required, making the system more bulky than desirable. Second, the turbine and blower must be permanently installed in the walls of the hose, thereby making it impractical in many present systems. Third, since the axles about which the blower and turbine rotate are installed in the walls of the hose, expensive seals will be required at the axle/hose wall interface to prevent the fuel from leaking. There are other pumps similar to that of Voelz, and all have the same problems.

It would therefore be desirable to provide an arrangement whereby a vapor recovery vacuum can be created which is proportional to the rate at which gasoline is being dispensed and which is simple, quick and easy to install in an existing gasoline dispensing hose.

SUMMARY OF THE INVENTION

The above problems are overcome in accordance with the present invention which relates to an improved vapor recovery system which can be easily inserted into an existing fuel dispensing system, and which creates a vapor recovery vacuum having a strength substantially proportional to the rate at which fluid is being dispensed. In accordance with the teachings of the invention, a section of pipe or hose comprising two concentric cylinders is utilized, where the inner cylinder is utilized to dispense fuel, and the space between the inner cylinder and the outer cylinder is utilized to effectuate vapor recovery. A turbine is disposed in the inner cylinder, which rotates as fuel flows therethrough, and such turbine is preferably magnetically coupled to a turbine in the outer cylinder. Rotation of the turbine in the inner cylinder causes rotation of the other turbine in the outer cylinder, thereby creating a vacuum in the outer cylinder. The vacuum created in the outer cylinder recovers the vapor.

Additionally, guide pipes may be installed in the inner cylinder to ensure that the fuel flowing therein is forced up against the turbine at the proper orientation to cause rotation of the turbine in the proper direction. As an optional enhancement, the magnetic coupling between the inner and outer turbines may be made weak enough so that after an amount of vapor is recovered into the fuel storage tank which causes vapor pressure in the fuel storage tank to go above a predetermined value, the outer turbine will no longer be able to turn. Therefore, no more vapor will be pumped into the fuel storage tank. Accordingly, the magnetic coupling between the inner and outer turbines operates as a safety clutch which shuts off the vapor recovery pump when a predetermined amount of vapor pressure builds up inside the fuel storage tank.

DETAILED DESCRIPTION OF THE PREFERRED EMBODIMENTS

Figure 1:
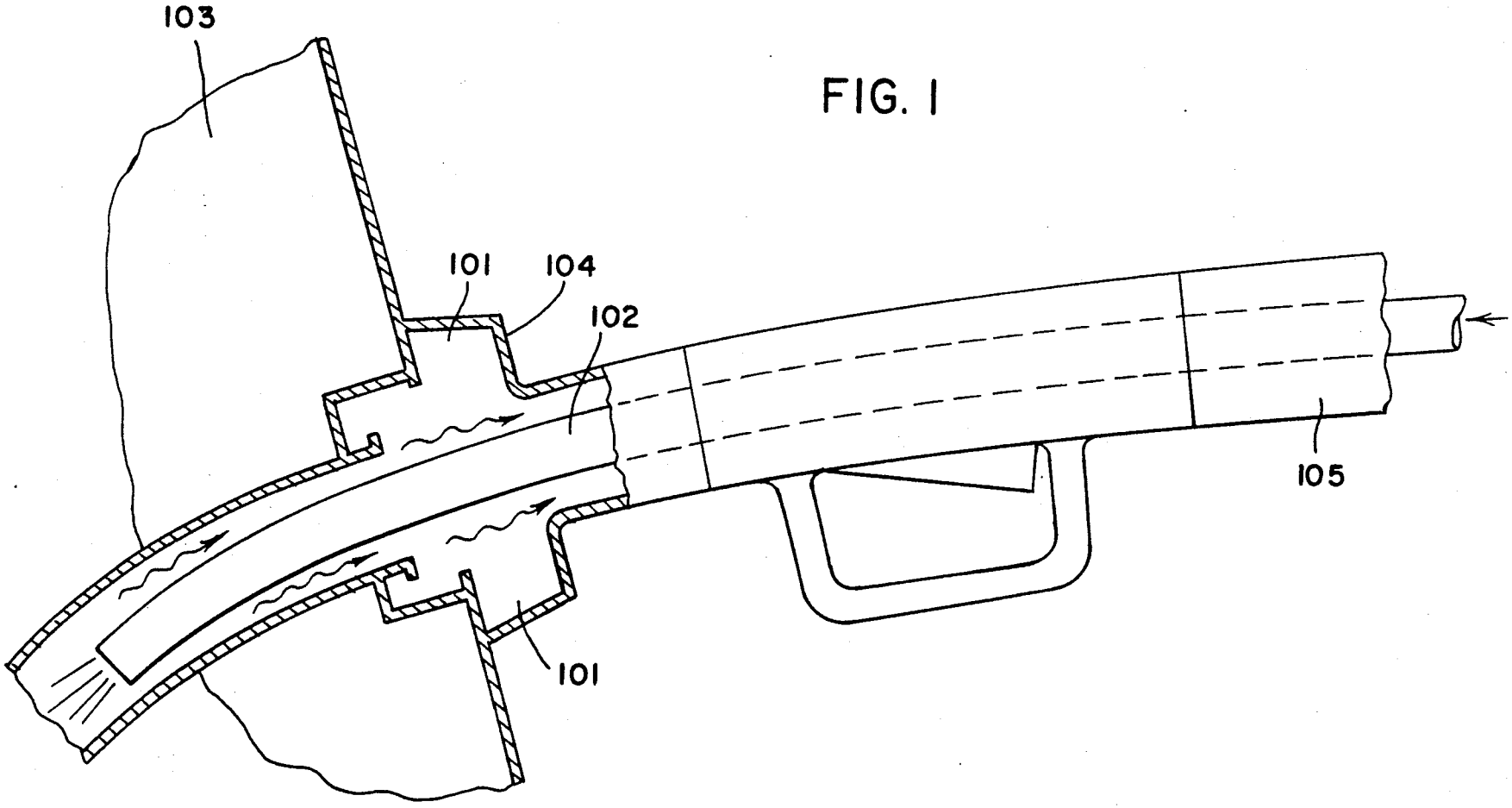
FIG. 1 is a typical prior art fuel dispensing hose and nozzle shown dispensing fuel into a conventional automobile gas tank.
Figure 2:
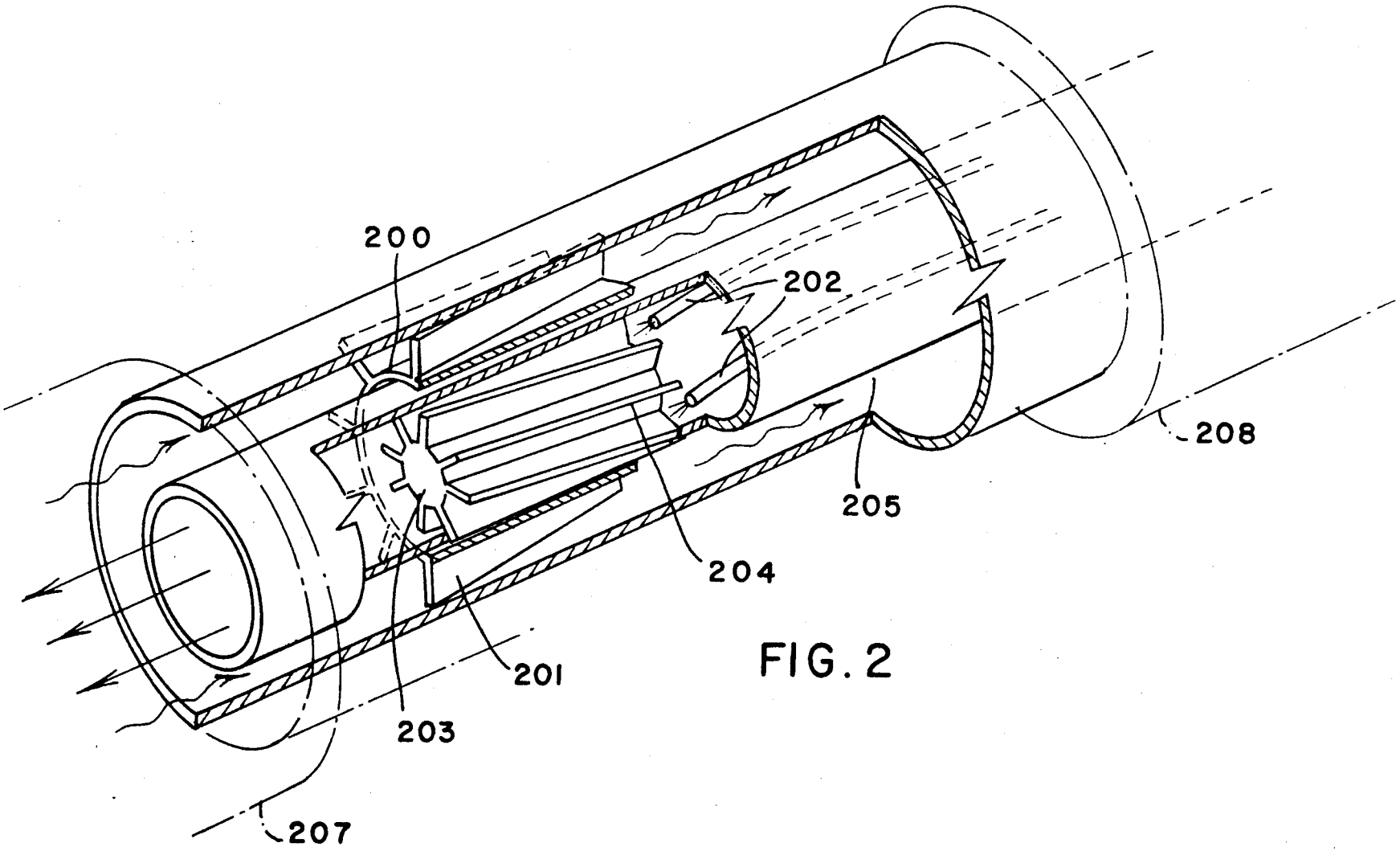
FIG. 2 is a perspective cut-away view of a vapor recovery pump incorporating the concepts and teachings of the present invention.

FIG. 2 depicts a small section of hose incorporating the teachings of the present invention. An inner turbine 203 includes vanes 204. Turbine 203 is disposed within inner hose 205. The flow of fuel within inner hose 205 is intended to be from right to left in FIG. 2. Outer turbine 200 includes vanes 201. Both inner turbine 203 and outer turbine 200 are free to rotate about their common longitudinal axis. Additionally, the inner and outer turbines are magnetically coupled as described hereafter. The turbine 200 and 203 are prevented from sliding longitudinally by any suitable means. For example, an axle-pin type bearing or thrust bearing may be used. The outer turbine is preferably implemented with a thrust bearing.

Optional flow directors 202 are disposed within inner hose 205 and direct the flow of fuel in a direction more perpendicular to the surface of vanes 204. This permits the power from the flowing fuel to be more efficiently translated into rotation of turbine 203.

In operation, fuel flows from right to left in FIG. 2. As the fuel flows past turbine 203, turbine 203 rotates, with the speed of rotation being proportional to the rate of flow of the fuel. Rotation of turbine 203 causes rotation of outer turbine 200 due to the magnetic coupling therebetween. The rotation of outer turbine 200 creates a vacuum in a direction opposite to that of the flow of fuel in inner hose 205. Specifically, as fuel flows from right to left in FIG. 2, a vacuum is created within outer hose 206 which pumps the vapors from left to right.

The transfer of energy contained in the fuel flowing from right to left into vacuum power from left to right can be accomplished by arranging the magnetic coupling so that rotation of the inner turbine 204 causes rotation in the same direction of outer turbine. The vanes 201 on the outer turbine are arranged in the opposite direction to the vanes in the inner turbine. Thus, although both turbines 200 and 203 would rotate in the sam direction, the force created by the rotation of outer turbine 200 would be opposite to the direction of fuel flow within inner hose 205.

In order to more effectively transfer the kinetic energy contained in the flowing fuel to rotational movement of turbine 203, flow directors 202 are optionally installed within inner hose 205. Fuel directors 202 are arranged to redirect the flow of fuel in a direction more closely perpendicular to the surface of vanes 204.

It is noted that while magnetic coupling has been described, a mechanical coupling between inner turbine 203 and outer turbine 200 may be utilized by providing a linkage, through the wall of inner hose 205, between the two turbines. While such an arrangement is possible, it is not believed to be preferred since dependable and expensive sealing technology would be required in order to ensure that the opening in the inner hose 205 utilized to link turbine 203 to turbine 200 with a mechanical linkage does not leak fuel.

Another optional enhancement to the invention allows the two turbines 203 and 200 to function as a safety clutch in order to prevent the vapor pressure within the fuel storage tank from increasing beyond a predetermined value. Specifically, as the vapors are pumped back into the fuel storage tank, the vapor pressure in the fuel storage tank will increase. It is desirable to not allow this vapor pressure to go beyond a predetermined value.

It can be appreciated that as pressure builds up in the fuel storage tank, such pressure opposes the rotation of turbine 200, which is attempting to pump more vapor into the fuel storage tank. Accordingly, it can be arranged that the magnetic coupling between turbines 203 and 200 is weak enough s that the force created by the increased vapor pressure in the fuel storage tank inhibits turbine 200 from turning when the vapor pressure becomes too great. In effect, the magnetic coupling "breaks" when it is desirable to shut off the vapor recovery system.

The vapors emanated after the maximum vapor pressure is reached are released into the atmosphere. However, when the pressure becomes great enough to break the coupling, the release of the vapors into the atmosphere is safer than building up too great a pressure within the fuel storage tank.

While calculations will yield the appropriate magnetic strength, it is believed that experimentation should also be carried out in order to more accurately determine the pressure at which the magnetic coupling breaks. More particularly, the arrangement in FIG. 2 can be installed in any experimental fuel delivery system. The pressure in the fuel storage tank can then be increased until turning of the inner turbine 203 will no longer turn the outer turbine 200. The magnetic force coupling the two turbines can then be varied until the proper strength of the magnetic coupling for a particular system is determined.

It should be emphasized that such a safety clutch would only be triggered in the most extreme of circumstances. Most fuel storage tanks include pressure vents to preclude the pressure from building up too high, and therefore, the magnetic safety clutch would only operate upon the failure of such pressure vents.

Figure 3A:
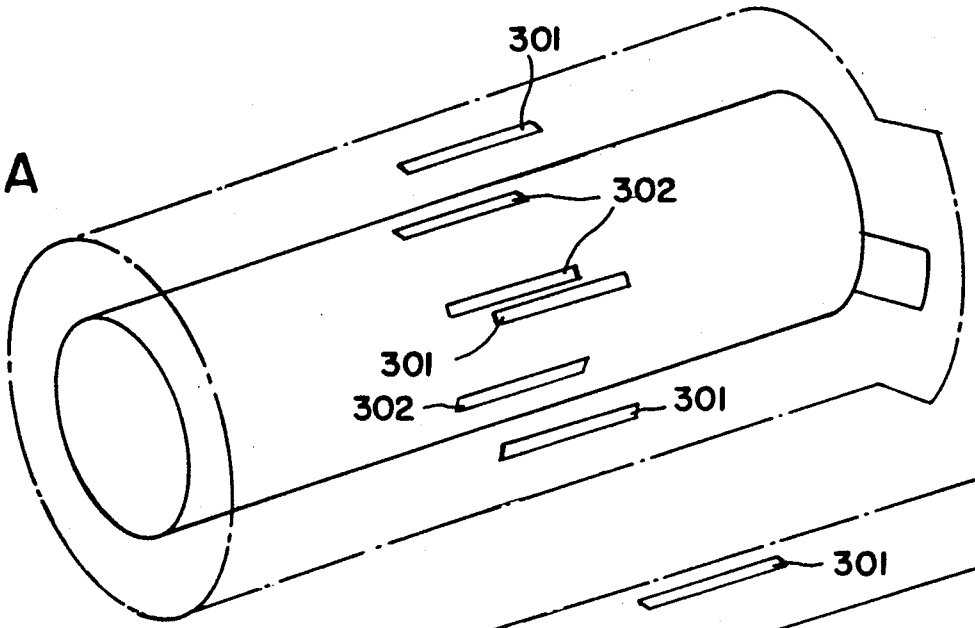
FIG. 3A is a cross-sectional view of a vapor recovery system arranged for maximum magnetic coupling.
Figure 3B:
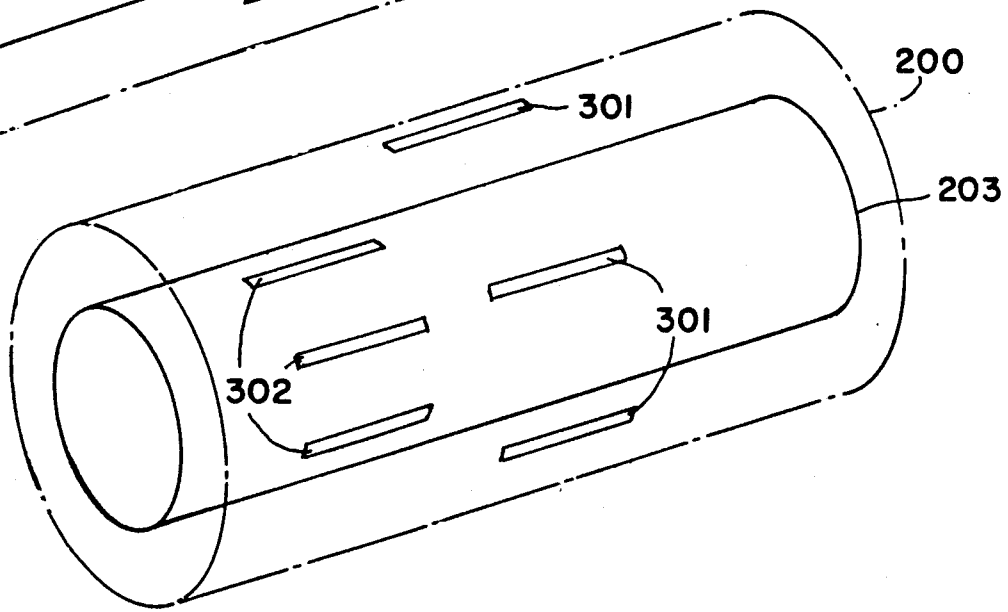
FIG. 3B is a cross-sectional view of a vapor recovery system arranged for relatively little magnetic coupling.

The magnets coupling turbines 200 and 203 may be movable to various different positions thereby creating stronger or weaker magnetic coupling as needed. For example, the magnets can be installed on the surfaces of turbines 200 and 203 so that their relative positions may be varied. When they are aligned exactly, coupling therebetween is the strongest and as they are moved apart, such coupling gets weaker. Such a system is shown in FIGS. 3A and 3B. The hoses and vanes of the turbines have been omitted for purposes of illustration and clarity.

Magnets 301 and 302 are installed in the turbines 200 and 203, respectively. Such magnets may be installed directly on the surface of the turbines, may be imbedded within the turbines or may be mounted using any other suitable technique. FIG. 3A shows the magnets being aligned longitudinally for a relatively strong magnetic coupling, while FIG. 3B shows the magnets longitudinally displaced from one another for relatively weak magnetic coupling. It should also be noted that the turbines 203 and 204 may slide longitudinally, relative to each other, rather than moving the magnets to vary the strength of the coupling. Such longitudinal repositioning of the turbines can be accomplished by moving whatever means are utilized to prevent longitudinal movement of the turbines. Normally, the consumer will not adjust the magnetic coupling, but the manufacturer will. The preferred embodiment is fixed position turbines.

It may also be desirable to install a check valve on the fuel storage tank where the vapors enter said tank. This results in a situation whereby if the vapor recovery pump stops pumping vapor due to an unexpected failure, the vapor will not leak out of the fuel storage tank through the vapor recovery paths. However, if other check valves are utilized in the system the vapor recovery system may not need one.

Returning now to FIG. 2, it is noted that couplings 207 and 208 may be designed to mate with the standard fuel dispensing hose couplings. The entire device in FIG. 2 can then be serially inserted into an existing coaxial fuel dispensing hose without redesigning any of the system. This is an added convenience not found in any prior art products.

While the above describes the preferred embodiments of the invention, it is apparent to those of ordinary skill in the art that various modifications and/or adaptations may be made without violating the spirit and scope of the invention. For example, the vanes on the turbine may be arranged at various angles, contours and orientations, and such turbines may be made of any suitable material. Moreover, the vanes may be installed on the inner or outer wall of the turbines. The outer hose may be used for fuel and the inner hose for vapor recovery, rather than vice-versa as described herein.

The device may be disposed anywhere along the fuel-dispensing hose, although it is preferable to install away from the nozzle so that it doesn't make the nozzle more bulky for the consumer to handle.

I claim:

1. Apparatus for recovering vapor in a fuel dispensing system, said apparatus comprising:

an inner hose and an outer hose, said inner hose being disposed within said outer hose;

a first turbine disposed within said inner hose; and a second turbine disposed outside said inner hose and inside said outer hose, said first turbine and said second turbine being coupled so that rotation of one of said turbines caused by fuel flowing powers rotation of the other of said turbines thereby causing vapor recovery, said turbines being cylindrical and each rotating about a longitudinal axis and installed within said hoses longitudinally with said longitudinal axes being parallel to the direction of fuel and vapor flow.

2. Apparatus according to claim 1 wherein said fuel flows in said inner hose and said vapor is recovered through said outer hose.

3. Apparatus according to claim 1 wherein said inner turbine and said outer turbine are magnetically coupled.

4. Apparatus according to claim 1 wherein said inner turbine and said outer turbine each include a plurality of vanes therearound.

5. Apparatus according to claim 1 further including a plurality of fuel directors for redirecting flow of fuel in said inner hose at a predetermined angle with respect to said vanes of said inner turbine.

6. Apparatus according to claim 1 having two ends each end including a coupling suitable for mating with a standard fuel dispenser coupling.

7. Apparatus according to claim 1 wherein said turbines are coupled with a force sufficiently weak so that when rotation of said outer turbine is opposed by a predetermined amount of vapor pressure built up during recovery of vapors, said coupling is broken and said outer turbine no longer rotates as a result of rotation of said inner turbine.

8. Apparatus for recovering vapor in a fuel dispensing system, said apparatus comprising:

an inner hose and an outer hose, said inner hose being disposed within said outer hose;

a first turbine disposed within said inner hose; and a second turbine disposed outside said inner hose and inside said outer hose, said first turbine and said second turbine being coupled so that rotation of one of said turbines caused by fuel flowing causes rotation of the other of said turbines thereby causing vapor recovery, said inner turbine and said outer turbine being arranged as concentric cylinders and said inner and outer hoses being arranged as concentric cylinders.

9. Apparatus according to claim 8 wherein said inner turbine and said outer turbine each include a plurality of vanes therearound.

10. Apparatus according to claim 8 having two ends each end including a coupling suitable for mating with a standard fuel dispenser coupling.

11. Apparatus for recovering vapor in a fuel dispensing system, said apparatus comprising:

an inner hose and an outer hose, said inner hose being disposed within said outer hose;

a first turbine disposed within said inner hose; and a second turbine disposed outside said inner hose and inside said outer hose, said first turbine and said second turbine being coupled so that rotation of one of said turbines caused by fuel flowing causes rotation of the other of said turbines thereby causing vapor recovery, each of said turbines including at least one magnet thereon, wherein the position of said magnets can be offset with respect to each other such that said magnetic coupling may be varied.

12. Apparatus for recovering vapor in a fuel dispensing system, said apparatus comprising:

an inner hose and an outer hose, said inner hose being disposed within said outer hose;

a first turbine disposed within said inner hose; and a second turbine disposed outside said inner hose and inside said outer hose, said first turbine and said second turbine being magnetically coupled so that rotation of one of said turbines caused by fuel flowing causes rotation of the other of said turbines thereby causing vapor recovery, each of said turbines including at least one magnet thereon, wherein the position of said magnets can be offset with respect to each other such that said magnetic coupling may be varied.

* * * * *